US005090896A

United States Patent [19]

Kenner et al.

[11] Patent Number: 5,090,896

[45] Date of Patent: Feb. 25, 1992

[54] CENTRAL HEATING FOR MOTOR VEHICLES AND SUCH MOBILE UNITS

[75] Inventors: Erich Kenner, Esslingen; Herbert Langen, Altbach, both of Fed. Rep. of Germany

[73] Assignee: J. Eberspächer, Esslingen, Fed. Rep. of Germany

[21] Appl. No.: 429,758

[22] Filed: Oct. 31, 1989

[30] Foreign Application Priority Data

Oct. 31, 1988 [DE] Fed. Rep. of Germany ..... 3837074

[51] Int. Cl.[5] ..... F23Q 7/08

[52] U.S. Cl. ..... 431/262; 126/110 B; 237/12.3 C

[58] Field of Search ..... 237/12.3 C, 2 A; 126/116 R, 110 B; 431/328, 327, 326, 208, 211, 230, 235, 239, 242, 329, 258, 259, 260, 263

[56] References Cited

U.S. PATENT DOCUMENTS 2,712,352 7/1955 Manor et al. ..... 431/261
4,530,658 7/1985 Panick ..... 237/12.3 C X
4,595,356 6/1986 Gaysert et al. ..... 237/12.3 C
4,789,331 12/1988 Kawamura ..... 431/261
4,836,444 6/1989 Kawamura ..... 237/12.3 C X

*Primary Examiner*—Henry A. Bennet
*Attorney, Agent, or Firm*—McGlew & Tuttle

[57] ABSTRACT

With a fluid fuel driven standard heating for motor vehicles, whose combustion chambers are equipped as vaporizer burners, a heater plug with open heater coils up to now would be installed in the usual way. What is disadvantageous for the operation, particularly in the starting, is the voltage dependence of such a heater plug. Also, with time an increasing carbonization would be established. According to the invention the vaporizing of the liquid fuel occurs under a seal by the use of a rod heater plug. The ignition can—independent of voltage—occur with the help of a spark plug (high voltage electrode). In a construction design the vaporizer is developed as a heat pipe, in which the rod heater plug is arranged.

7 Claims, 1 Drawing Sheet

CENTRAL HEATING FOR MOTOR VEHICLES AND SUCH MOBILE UNITS

FIELD OF THE INVENTION

The invention generally concerns central heating for motor vehicles and more particularly concerns a vaporizer burner for liquid fuel.

BACKGROUND OF THE INVENTION

There are different types of outside or standard heating for motor vehicles, airplanes and other mobile units. In regard to the special development of the burners one distinguishes for example between rotating distribution burners, spray gun burners, and vaporizer burners. The present invention relates to the last named type.

In this type a vaporizer burner is arranged inside a somewhat concentric shell combustion chamber for blowing combustion air axially or tangentially into the combustion chamber. In the combustion chamber the vaporizer is situated such that it is mostly radial in relation to the combustion chamber. In the usual convention this heating consists of a heater plug with an exposed lying heater coil within a cylindrical body, in which for example with a fiber packing provided at a circumferential area, fuel will be lead. Through the insertion of the heater plug the fuel vaporizes, as it reaches the heating temperature for ignition.

It has been observed that the starting of the operation of such a standard heater with a vaporizer burner experiences difficulties under certain circumstances. The reason being that the obtained temperature from the heater plug depends very heavily on the respective operating voltage at the given time. As is well known, the operating voltage in a motor vehicle is subject to considerable deviation (independent of loading conditions and independent of other loads of the board battery), so that the start of the burning activity is dependent on the working voltage that is directly at disposal.

Further it is established, that after a certain amount of time of operation a carbonization of the heater plug takes place, whereby the operation at the starting process is even more unstable. The carbonization is fed back on it, so that the air and fuel reaches the heater plug.

SUMMARY AND OBJECTS OF THE INVENTION

It is an object of the invention to create a central heating arrangement for motor vehicles and the like, by which a reliable start of the burner operation is guaranteed.

According to the invention, a rod heater plug is provided in the fuel evaporator or vaporizer, and for the starting of the burner, a high voltage electrode is arranged in the vicinity of the vaporizer.

Preferably the rod heater plug is so arranged that the vaporizing process is sealed from the air.

According to the invention, it is possible to do this without having heater plugs with open heater coils which had normally been utilized. The ignition occurs with the help of a spark plug (high voltage electrode). Thereby the starting process of the burner of the heating will be voltage independent. The temperature on the vaporizer thereby lies stable over a value around 300 degrees Celcius.

In a further development of the invention, it is provided that the vaporizer is arranged approximately on the longitudinal center axis of the combustion chamber having a tangential air supply. Basically the combustion air blower can be axially arranged so that the combustion air will be blown into the combustion chamber in substantial axial symmetry. In this case, the vaporizer is arranged radially in relation to the combustion chamber. In the preferred development of the invention the delivery of the combustion air nevertheless occurs tangentially, while the vaporizer is axially arranged. This allows a compact construction of the entire central heating.

In a variant of the invention, the vaporizer is provided with a perforated cylinder body, (for example, formed of metal or ceramics) with a filter liner or an inserted fiber packing, while the heater plug is arranged concentrically in the cylinder body. In another variant, the vaporizer is formed with a heat pipe, which the rod heater plug surrounds. Heat pipes are generally known. However, the heat pipe cooperating with the other features of the invention provides a heat transference, without outer influence, from the side of lower temperature to the side of higher temperature. This capacity is utilized by the invention. The fuel delivery occurs on the side of lower temperature, while on the other side of the heat pipe the vapor outlet leads to the combustion chamber. The rod heater plug is practically shut off from the air supply. The vaporized fuel arrives in the combustion chamber with a sufficiently high temperature. Also in this variant a tangential air supply is preferable provided for.

Out of the above described advantages, from which the avoidance of an open heating coil is prominent, the possibility will in favorable ways be opened by the invention for flame control to be achieved with the help of a high voltage electrode. In addition to this, a voltage produced will be measured on the high voltage electrode through the ionization in the area of the electrode that varies with the intensity of the flame.

A further object of the invention is to provide a heating arrangement which is dependable, safe, simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
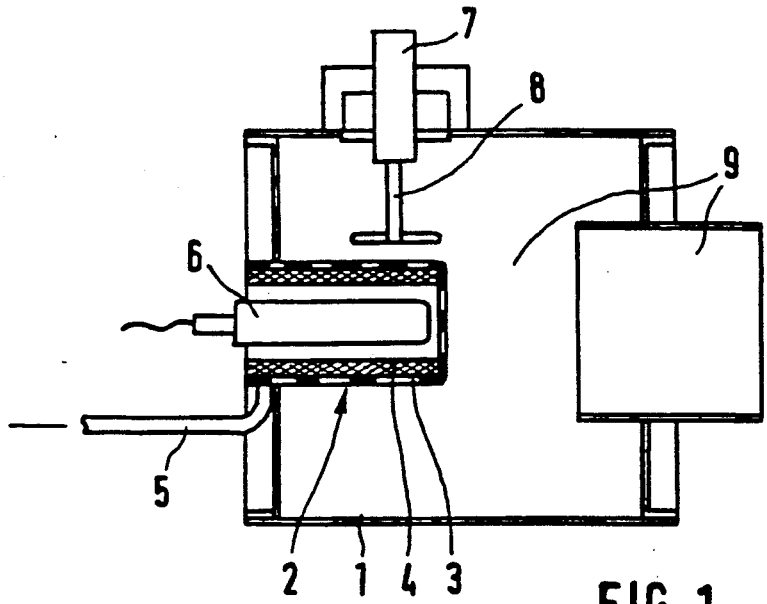
FIG. 1 is a longitudinal sectional view of a heating arrangement for motor vehicles with vaporizer burner.

Referring to the drawings, in particular, the invention embodied therein comprises a central heating unit for a vehicle or the like, including a vaporizer burner, generally designated 2 (22 in FIG. 2) which vaporizer burner is adapted for use with liquid fuel. The burner arrangement is included with a rod heating plug 6 positioned within the vaporizer burner unit. A high voltage electrode means 8 is provided positioned adjacent the vaporizer burner 2 for starting the vaporizer burner.

FIG. 1 shows in a simplified representation a section of a vaporizer burner of a heating unit for a motor vehicle. The arrangement includes a middle section of a casing 1, in which one of an electromotor driven combustion air blowers is preferably flanged laterally to provide a tangential combustion air lead. On the right side in FIG. 1, a flame pipe is situated that is not represented here, that is surrounded by a heat exchanger.

Concentrically to the longitudinal axis of the cylindrical casing 1, the vaporizer 2 is held in the casing. The vaporizer 2 encloses a cylindrical cup shaped body 3 consisting of metal, along whose inner walls a fuel evaporator means 4, preferably a fiber packing is arranged. In the remaining interior the rod heater plug 6 is situated, that will be held on the left side of the casing and is attached by an adapted cable to a voltage source.

A fuel line 5 empties tangentially into the cylindrical body 3.

Radially, with respect to the cylinder body 3, a high voltage electrode 8 is arranged that is held on the casing from a support 7, that receives a high voltage ignition impulse for the starting of the burners. In the combustion chamber 9 a flame itself develops, that warms up the mentioned (but not represented in the diagram) heat exchanger for a heated fluid carrier or the like.

For the starting of the vaporizer burner a fuel meter pump that is not represented here will be set into motion, so that fuel will be provided over the fuel line 5 into the vaporizer. There the fuel spreads itself into the fiber packing 4, whereby the vaporizing occurs, sealed from the air, by an inserted rod heater plug 6.

By way of example, with the insertion of the fuel meter pump the combustion air blower simultaneously will be inserted, so that the vaporized fuel will be sufficiently mixed with combustion air in combustion chamber 9. After a certain time an ignition impulse will be given on the high voltage electrode 8, so that the mixture will be ignited.

After the reaching of the operation temperature the rod heater plug 6 will be disconnected and the vaporizer remains in thermal equilibrium.

The fuel delivery will be shut off for a time, disconnection of the burner while the combustion air blower can run for an additional period of time, in order to burn out the rest of the fuel out of the vaporizer, while the rod heater plug can also still be inserted during this smoldering time.

Figure 2:
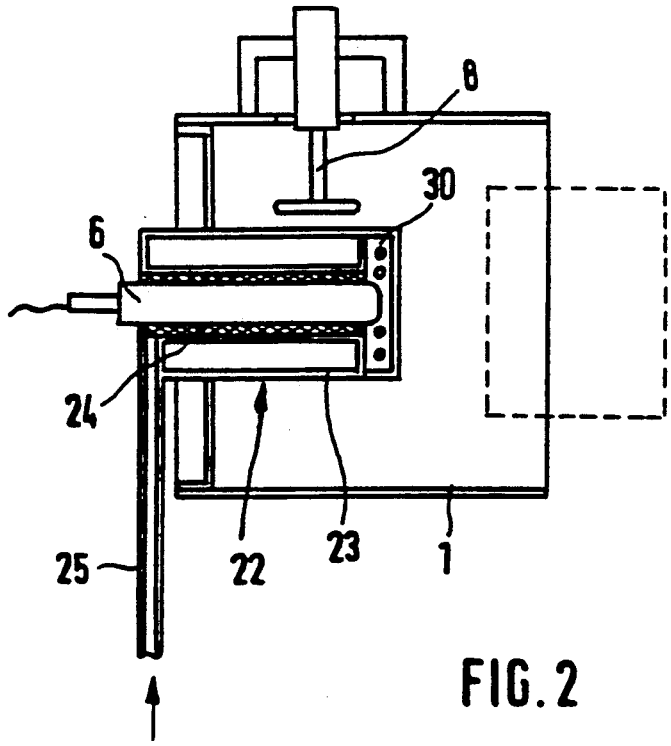
FIG. 2 is a cross sectional view of a modified embodiment of the invention taken in the same direction as the embodiment according to FIG. 1.

In a stationary operation, flame control must occur in or on the burner. In the arrangement represented in FIG. 1 the flame control happens with the help of the high voltage electrode 8, over which the amount of ionization of the gases in the area of the high voltage electrode can be determined with the help of a voltage meter. FIG. 2 shows a variant of the invention that is especially preferred. In FIG. 2, the same sections as in FIG. 1 are furnished, with appropriate reference marks. The vaporizer 22 is formed of a heat pipe 23. The heat pipe 23 has an interior in which the rod heater plug 6 is arranged, adjacent an intermediate positioned sieve 24. A fuel line 25 leads into the area of the outer end of the rod heater plug.

In the area of the combustion chamber the vaporizer possesses a vapor outlet 30 on the front of the rod heater plug 6. The steam outlet is a flat chamber with more radial openings along to the combustion chamber.

The effect of the heat pipe 23 is such that the heat energy will be transported from left to right in FIG. 2, (that is, towards the warmer side). Thereby vaporized fuel is conversed out of the area around rod heater plug 6 to the vapor outlet chamber 30, and from there into the combustion chamber, in which the vapor will be mixed preferably tangentially, with injected combustion air. The ignition here still occurs over a high voltage electrode 8 that also makes a precise flame possible.

While specific embodiments of the invention have been shown and described in detail to illustrate the application of the principles of the invention, it will be understood that the invention may be embodied otherwise without departing from such principles.

What is claimed is:

1. A central heating unit, comprising:

a vaporizer burner housing;

a vaporizer burner including a cylindrical cup shaped vaporizer body surrounding an evaporation element;

a rod heating plug positioned within the vaporizer burner surrounded by the evaporation element;

a liquid fuel line connected to the evaporation element for supplying fuel to the evaporation element;

high voltage electrode means positioned adjacent the vaporizer burner cylindrical cup shaped body for starting the vaporizer burner.

2. A central heating unit according to claim 1, wherein the rod heating plug is sealed within said vaporizer burner.

3. A central heating unit according to claim 1, wherein said vaporizer burner is positioned within said vaporizer burner housing defining a tangential air supply around a central longitudinal axis of the burner housing.

4. A central heating unit according to claim 1, wherein the vaporizer includes a perforated cylindrical body, said heater plug being arranged concentrically with respect to said cylindrical body, packing means being positioned between said cylindrical body and said rod heater plug.

5. A central heating unit according to claim 4, wherein said voltage electrode mean includes a voltage electrode positioned adjacent the vaporizer burner, said voltage electrode means for monitoring the operation of the vaporizer burner.

6. A central heating unit for a vehicle, comprising:

a mobile unit vaporizer burner housing;

a cup shaped vaporizer body surrounding an evaporation element, said cup shaped vaporizer body being positioned within the vaporizer burner housing;

a rod heating plug positioned within the evaporation element, said evaporation element including fiber packing, positioned in said cup shaped vaporizer body, surrounding said rod heating plug;

a liquid fuel line connected to said evaporation element for supplying fuel to said fiber packing; and high voltage electrode means positioned in said vaporizer burner housing spaced from said evaporation element.

7. A central heating unit, comprising:

a vaporizer burner for liquid fuel;

a rod heating plug positioned within the vaporizer burner, said vaporizer burner including means defining a heat pipe surrounding said rod heating plug; and high voltage electrode means positioned adjacent the vaporizer burner for starting the vaporizer burner.

* * * * *